United States Patent [19]

Mastrobuono

[11] Patent Number: 5,048,311

[45] Date of Patent: Sep. 17, 1991

[54] CONVERTIBLE JEWELRY ARTICLE

[76] Inventor: John Mastrobuono, 399 Comstock Pkwy., Cranston, R.I. 02921

[21] Appl. No.: 569,851

[22] Filed: Aug. 17, 1990

[51] Int. Cl.[5] ..... A44C 7/00

[52] U.S. Cl. ..... 63/12; 63/14.5; 63/20; 63/29.1; 24/662

[58] Field of Search ..... 63/12, 1.1, 29.1, 20, 63/21, 23, 14.5; 24/662, 664, 666, 669, 681

[56] References Cited

U.S. PATENT DOCUMENTS

| | | | |
|---|---|---|---|
| 300,509 | 6/1884 | Richardson | 624/662 |
| 775,882 | 11/1904 | Zindorf | 24/666 X |
| 966,125 | 8/1910 | Rojas | 63/29.1 |
| 1,981,521 | 11/1934 | Mayer | 63/20 X |
| 2,274,269 | 2/1942 | Jellinek | 63/20 X |
| 3,122,007 | 2/1964 | Horland | 63/14.5 X |
| 3,133,331 | 5/1964 | Marticorena | 63/29.1 X |
| 4,682,477 | 7/1987 | Vaillancourt | 63/12 |
| 4,959,890 | 10/1990 | Pazurek | 63/29.1 X |

FOREIGN PATENT DOCUMENTS

| | | | |
|---|---|---|---|
| 757524 | 12/1933 | France | 63/29.1 |
| 1065277 | 5/1954 | France | 63/29.1 |
| 1157121 | 5/1958 | France | 63/29.1 |
| 548961 | 7/1957 | Italy | 63/29.1 |
| 830126 | 3/1960 | United Kingdom | 63/29.1 |

*Primary Examiner*—Laurie K. Cranmer
*Attorney, Agent, or Firm*—Robert F. O'Connell

[57] ABSTRACT

A convertible jewelry article for use by a wearer and including an ornamental member having a holding bracket secured thereto, the holding bracket being formed with a dome portion, the interior of which is shaped to receive a semi-spherical member therein. The semi-spherical member is formed as part of a mounting element such as an earring post, an earring clamp, or a necklace, the dome portion receiving the semi-spherical member therein for mounting a selected ornamental member on the mounting element, whereafter the mounting element is secured in place on the wearer for locating the selected ornamental member in a position of use thereon, and the mounting element being selectable in accordance with the intended use thereof by the wearer.

9 Claims, 1 Drawing Sheet

CONVERTIBLE JEWELRY ARTICLE

BACKGROUND OF THE INVENTION

The present invention relates to a convertible jewelry article for use by a wearer and provides for the use of a selected ornamental member with one of a plurality of mounting elements so that the selected ornamental member is convertible for use for different purposes, such as for an earring, a bar pin, or a necklace assembly.

Prior to the instant invention, some convertible jewelry devices have been known, but essentially these prior known devices have consisted of changing the ornamentation of a base member as mounted on a mounting element that is secured in a convenient manner on a user. Thus, if the convertible jewelry article was in the form of an earring, the ornamental portion of the earring was interchanged with a similar ornamental portion of different coloration or design. In this instance, the means for mounting the earring in place was the same. Other efforts to modify the mounting means for an ornamental articles such as an earring have also been suggested, and one example of this type of device is illustrated in the U.S. Pat. No. to HORLAND 3,122,007. In the HORLAND patent, a structure is disclosed, wherein the use of a post is interchanged with a clasp, but this form of device was essentially for the purpose of using the ornament either with a post earring or with a clamp earring. Hence there is no disclosure in this patent of utilizing the ornament with a different form of a mounting element or for utilizing other ornamental members that are also constructed for accepting different mounting elements.

Other devices of similar purpose to that of the HORLAND patent and which define the most pertinent prior art of which applicant is aware are the U.S. Pat. Nos. to BATTIST No. 2,501,754, ARZT 2,813,407, EBERTIN 2,722,811, CECERE, et al 4,003,216, and BOYLAND No. 948,917. Although the EBERTIN U.S. Pat. No. 2,722,811 does suggest using an earring clamping means for a purpose other than as an earring, such as a clamp-on to a dress, the structure of that device remains essentially the same, which is distinguishable from the subject invention which provides for using an ornamental member with selected mounting elements of different structure.

As will be evident, none of the prior art devices as referred to hereinabove show or suggest the concept of applicant's invention which provides for using the same type of holding bracket on ornamental articles with various kinds of mounting elements for mounting an ornamental article on the wearer.

SUMMARY OF THE INVENTION

The present invention relates to a convertible jewelry article for use by a wearer comprising an ornamental member having a backing to which a holding bracket is secured. The holding bracket is formed with a dome portion, the interior of which is shaped to receive a semi-spherical member. A mounting element is provided for mounting the ornamental member in a position for use on the wearer, the mounting element including a semi-spherical member that is removably received in the dome portion of the holding bracket. The mounting element is joined to the semi-spherical member and provides for locating the ornamental member in the position of use on the wearer.

In order to provide for converting the use of the ornamental member as worn by the wearer, different forms of mounting elements are provided and include, for example, an earring post, an earring clamp, a bar pin, or a necklace coupling member all of which are selectively attachable to the backing element of the ornamental member. Thus, the ornamental member is convertible for use with the various types of mounting elements to enable the ornamental member to be worn by a wearer for different purposes.

Accordingly, it is an object of the present invention to provide a convertible jewelry article wherein a selected ornamental member is removably mounted in place on one or more of mounting elements, each of which is provided with a common mounting means that is removably securable to the ornamental member.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
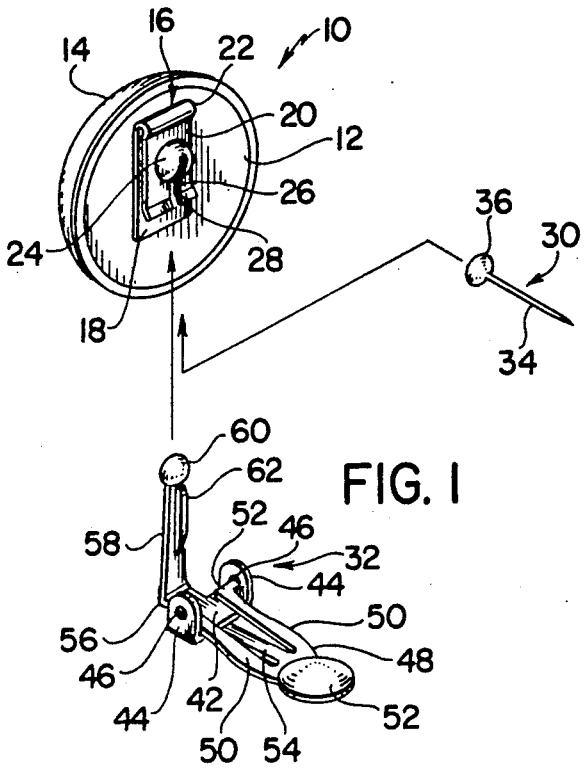
FIG. 1 is a perspective view showing an ornamental member having a holding bracket secured to the rear surface thereof for receiving either an earring post or an earring clamp in mounting relation thereon depending upon the preferred use of the member.

Referring now to the drawing and particularly to FIG. 1, an ornamental member is illustrated and is generally indicated at 10, the ornamental member 10 being only representative of one form of an ornament that is intended for use with the present invention as will be described. As shown in FIG. 1, the ornamental member 10 includes a backing member 12 on which an ornament 14 of any suitable design is mounted. As illustrated in both FIGS. 1 and 2, a holding bracket generally indicated at 16 is secured to the backing member 12 in any suitable manner such as by soldering or an adhesive, the holding bracket 16 being defined by a rear plate 18 to which a front plate 20 is joined by a rolled spring connection 22. The front plate 20 is disposed in parallel relation with respect to the rear plate 18 but is spring mounted relative thereto for the purpose as will hereinafter be described. Integrally formed on the front plate 20 is a dome portion 24 the interior of which is semi-spherical in configuration. The longitudinal dimension of the front plate 20 is foreshortened with respect to the length of the rear plate 18, and a slot indicated at 26 extends through the front plate 18 into the dome portion 24. As further illustrated in FIGS. 1 and 2, the slot 26 which bisects the lower portion of the front plate 20 also forms opposed feet 28 that are outurned and define lead-in means for receiving a spherical member of a mounting element as will hereinafter be described.

Figure 2:
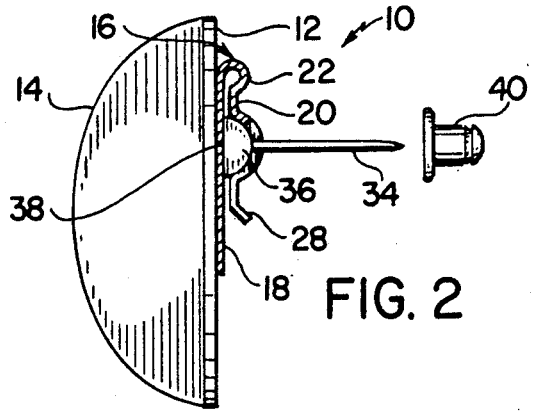
FIG. 2 is a side elevational view of the ornamental member shown in FIG. 1 with parts shown in section and illustrating the use of an earring post in combination therewith, an earring clutch for attachment to the post being shown in exploded view.

As also shown in FIG. 1, a mounting post generally indicated at 30 or a mounting clamp member generally indicated at 32 are selectively used to receive thereon the ornamental member 10. Considering first the use of the mounting post 30, reference is now made to FIG. 2. The mounting post 30 includes an elongated post element 34 to which is attached a semi-spherical member 36 having a flat bottom portion indicated at 38 in FIG. 2. The shape and configuration of the semi-spherical portion 36 is such that it is snugly seated within the dome portion 24 of the holding bracket 16. The diameter of the post element 34 is also dimensioned for being received in the slot 26. Thus when it is desired to use the ornamental member 10 as a post type of an earring article, the mounting post 30 is located in place on the holding bracket 16 by inserting the semi-spherical portion 36 within the dome portion 24. This is accomplished by sliding the dome portion 36 beneath the feet 28 and behind the spring mounted front plate 22 as the post element 34 slides within the slot 26. When the semi-spherical portion reaches the dome portion 24 it is snugly seated therein with the post element 34 directed outwardly thereof as seen in FIG. 2. A conventional clutch 40 as shown in FIG. 2 cooperates with the post element 34 to lock the ornamental member 10 on the earlobe of a wearer in the conventional manner.

If it is desired to convert the ornamental member 10 from a post type of earring to a clamp type of earring, the post member 30 is withdrawn from its seated position on the holding bracket 16, and the clamp member 32 is then inserted in place thereof. As shown in FIG. 1, the clamp member 32 comprises a bracket 42 to which upturned and spaced ears 44 are joined. Both of the spaced ears 44 are provided with an opening 46 therein. A conventional clamp element 48 having spaced legs 50 formed thereon is secured to the bracket 42 by forming the spaced legs with outturned foot portions 52 that are received in the openings 46. The legs 50 terminate at the outermost end thereof in a generally circular plate 54 that is designed to engage the rear surface of the wearer's earlobe. A central spring element 54 that is joined to the member 48 and that is disposed between the legs 50 engages the rear surface of the bracket 42 and acts to spring load the clamp element 48 when it is moved into engagement with the rear surface of the wearer's earlobe.

As further shown in FIG. 1, an extension 56 is joined to the bracket 42 and an elongated arm 58 is joined to the extension 56 at right angles with respect thereto. Terminating at the upper end of the leg 58 is a semi-spherical portion 60, the configuration of which is similar to the semi-spherical portion 36 of the post member 30. Also formed on the leg 58 is an elongated rib 62 that extends for a portion of the length of the leg 58.

Figure 3:
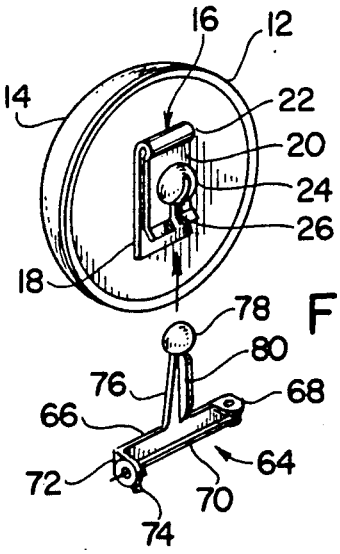
FIG. 3 is a perspective view of an ornamental member as illustrated in FIG. 1 as it is intended for use thereof with a bar pin.

In mounting the ornamental member 10 on the clamp member 32, it is seen that the leg 58 on which the semi-spherical member 60 is mounted is inserted behind the spring loaded front plate 20 of the holding bracket 16, the rib 62 sliding into the slot 26 thereof. When the semi-spherical member 60 is seated within the dome portion 24, the ornamental member 10 is locked in place on the clamp member 32, and the assembly is then used as a clamp earring in a conventional manner. Referring now to FIG. 3, another modified form of the invention is illustrated, and it is seen that the holding bracket 16 a mounted on the rear plate 12 of the ornamental member 10 is identical in construction as described hereinabove. In order to convert the use of the ornamental member 10 to a bar pin, for example, a bar pin construction generally indicated at 64 in FIG. 3 is utilized, the bar pin construction 64 including a bracket 66 that has opposed ears 68 formed on one end thereof in which a pin 70 is pivotably mounted in conventional manner. Located on the bracket 66 and opposite to the ears 68 is another ear 72 that is formed at right angles with respect to the bracket 66 and that is provided with a lock mechanism 74, also of conventional design. Thus it is seen that the pin 70 is pivotably moved with respect to the bracket 66 for releasing the pin 70 for securement to a garment of the wearer and then being reinsertable within the lock assembly 74 as required.

Joined to the bracket 66 is an upstanding leg 76 on the outermost end of which a semi-spherical portion 78 is mounted. The semi-spherical portion 78 also has a configuration similar to the semi-spherical portions 36 and 60 as described hereinabove. Formed on the upstanding leg 76 is an elongated rib 80 which is similar to the rib 62 as described above in connection with the clamp member illustrated in FIG. 1. It is seen that the semi-spherical member 78 is designed to be seated within the dome portion 24 of the holding bracket 16, the rib 80 being received within the slot 26 of the holding bracket and cooperating with the dome portion 24 for aiding and locking the ornamental member 10 on the bar pin 64.

Figure 4:
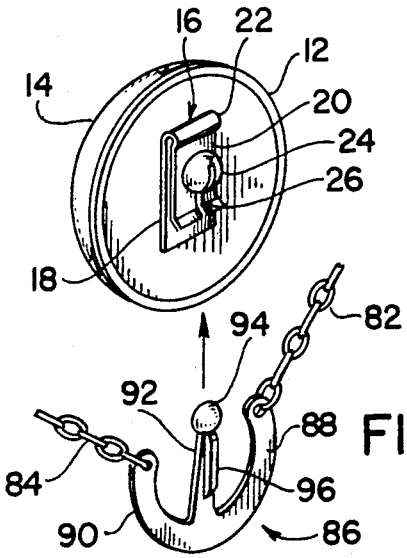
FIG. 4 is also a perspective view of the ornamental member as illustrated in FIG. 1 and showing the use thereof with a necklace as attached to a coupling member that is formed as an integral part thereof.

A further modification of the invention is illustrated in FIG. 4, wherein the ornamental member 16 is mounted on a necklace the end portions of which are indicated at 82 and 84. Connecting the end portions 82 and 84 of the necklace is a coupling member generally indicated at 86 that includes curved arms 88 and 90 that are joined at the center of the coupling member 86 and to which an upstanding leg 92 is joined centrally of the curved legs 88 and 90. The leg 92 is formed similarly to the legs 58 and 76 as illustrated in FIGS. 1 and 3 respectively, and has a semi-spherical portion 94 mounted on the outermost end thereof, and further has a longitudinally extending rib 96 formed thereon. The ornamental member 10 is mounted on the necklace coupling 86 by inserting the semi-spherical portion 94 within the dome 24 of the holding bracket 16, the rib 96 extending into the slot 26 thereof.

It is seen that the subject invention provides for the conversion or use of the ornamental member 10 to a variety of mounting elements depending upon the preferred use thereof. It is understood that a plurality of ornamental members having different designs and/or configurations can be provided with a holding bracket 16 thereon, and then selectively utilized as a post or clamp earring, or as a bar pin or necklace ornament in accordance with the desire of the wearer and as described hereinabove.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible jewelry article for use by a wearer, comprising an ornamental member having a backing to which a holding bracket is secured, said holding bracket having a dome portion the interior of which has a semi-spherical shape, and means for mounting said ornamental member in a position of use on said wearer, said mounting means including a semi-spherical member that is removably received in the semi-spherical shaped interior of the dome portion of said holding bracket in seated relation therewith, a longitudinal slot being formed in said holding bracket and extending into said dome portion and an elongated element that is joined to said semi-spherical member, said element being received in said slot for aiding in removably locking said holding bracket and ornamental member on said mounting means.

2. A convertable jewelry article as claimed in claim 1, said holding bracket including a base that is secured to the backing of the ornamental member and a plate joined to said base on which said dome portion is located.

3. A convertible jewelry article as claimed in claim 2, wherein said elongated element is an elongated post that is joined to said semi-spherical member, said post being insertable through an earlobe of said wearer for mounting said ornamental member thereon.

4. A convertible jewelry article as claimed in claim 2, wherein said mounting means having a fixed leg and a pivotal clamp arm that is pivotably moved into clamping position relative to said fixed leg, said fixed leg including a free end, said semi-spherical member being joined to the free end of said fixed leg and being received in the interior of said dome portion of said holding bracket in seated relation therewith for removably mounting said ornamental member on said clamp member.

5. A convertible jewelry article as claimed in claim 4 wherein said elongated element is a longitudinally extending upstanding rib formed on said fixed leg, said rib being received in said slot for aiding in removably locking said holding bracket and ornamental member on said clamp member.

6. A convertible jewelry article as claimed in claim 2, wherein said mounting means is a bar pin to which a fixed leg is joined, said fixed leg having a free end on which said semi-spherical member is located, said semi-spherical member being removably received in the interior of said dome portion of said holding bracket in seated relation therewith for removably mounting said ornamental member on said bar pin.

7. A convertible jewelry article as claimed in claim 6, wherein said elongated element is a longitudinally upstanding rib formed on said fixed leg, said rib being removably received in said slot to provide for slidable movement of said holding bracket and ornamental member with respect to said bar pin.

8. A convertible jewelry article as claimed in claim 2, wherein said mounting means is a coupling member having free ends to which ends of an ornamental jewelry chain are connected, said coupling member further including a fixed leg having a free end on which said semi-spherical member is located, said semi-spherical member being removably received in seated relation with the interior of said dome portion of said holding bracket for removably mounting said ornamental member on said chain coupling.

9. A convertible jewelry article as claimed in claim 8, wherein said elongated element is a longitudinally extending rib formed on said fixed leg, said rib being removably received in said slot to provide for slidable movement of said holding bracket and ornamental member with respect to said coupling member.

* * * * *